United States Patent [19]

Ollinger

[11] 4,070,125

[45] Jan. 24, 1978

[54] SUSPENDED CEILING RUNNER

[75] Inventor: James C. Ollinger, Lancaster, Pa.

[73] Assignee: Armstrong Cork Company, Lancaster, Pa.

[21] Appl. No.: 780,417

[22] Filed: Mar. 23, 1977

[51] Int. Cl.[2] ..... E04C 2/42

[52] U.S. Cl. ..... 403/230; 52/664

[58] Field of Search ..... 52/488, 497, 498, 664–669, 52/484, 461; 403/230, 245, 263

[56] References Cited

U.S. PATENT DOCUMENTS

| | | | |
|---|---|---|---|
| 1,074,895 | 10/1931 | Rapp | 52/461 |
| 3,016,997 | 1/1962 | Price | 52/668 |
| 3,633,952 | 7/1970 | Nikolaus | 403/230 |
| 3,835,614 | 9/1974 | Downing | 52/666 |

FOREIGN PATENT DOCUMENTS

| | | | |
|---|---|---|---|
| 403,258 | 11/1965 | Switzerland | 52/498 |

*Primary Examiner*—James L. Ridgill, Jr.

[57] ABSTRACT

The invention is directed to a ceiling runner which has a generally U-shaped configuration. The runner has flanges to support ceiling boards. The side walls of the runner are formed with grooves which may be used to support the runner in position or define an isolated chamber within the body of the runner.

2 Claims, 3 Drawing Figures

SUSPENDED CEILING RUNNER

BACKGROUND OF THE INVENTION

1. Field of the Invention

The invention is directed to a suspended ceiling system and, more particularly, to a runner member of a specific configuration for use in the suspended ceiling system.

2. Description of the Prior Art

U.S. Pat. No. 2,447,694 is directed to a runner structure having a configuration somewhat similar to that of the claimed invention. The runner structure therein is not an exposed grid member in that it cannot be viewed from below a suspended ceiling system, and it functions primarily as a fastening means for another runner in a concealed grid system suspended ceiling.

U.S. Pat. No. 3,067,323 is directed to another runner structure which has cross-sectional configuration somewhat like the claimed invention. Again, the patented structure differs from the claimed invention primarily in the fact that the patented structure is not formed to be mounted as per the claimed invention, and that the patented structure does not have flanges for supporting a ceiling system.

Finally, U.S. Pat. No. 3,708,932 is directed to a grid member having a structure slightly similar to the claimed invention. The primary difference between the patented structure and the claimed invention is the positioning of the groove structure in the side walls of the runner member.

The claimed invention is a specifically designed runner structure which is meant to carry out specific functions, as will be set forth below.

SUMMARY OF THE INVENTION

The invention herein is a ceiling runner which is to be used in a ceiling suspension system. The runner is of a generally elongated, inverted U-shaped configuration. The runner has two partly inclined side walls which are connected together by a flat top member. The runner has horizontal flanges which are used to support ceiling boards. The side walls of the runner have grooves therein, and said grooves extend outwardly from the side walls to form two parallel ledges inside of the U-shaped body configuration of the runner. The grooves are positioned about midway of the side walls of the runner.

DESCRIPTION OF THE PREFERRED EMBODIMENT

Figure 1:
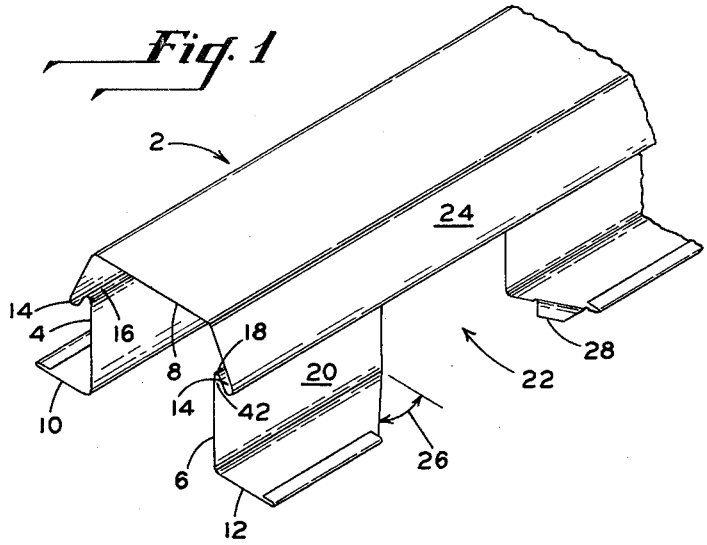
FIG. 1 is a perspective view of the runner structure having its side arranged to receive the end of another runner structure.

The sheet metal elongated runner structure 2 herein has generally the cross-sectional configurations shown in FIG. 1. The cross-sectional configuration is generally an inverted "U" shape with side walls 4 and 6. The side walls 4 and 6 are connected together by a flat top member 8. Horizontal flanges 10 and 12 extend outwardly from the runner member 2 at the lower ends of the side walls 4 and 6. It is on these about ½ inch wide flanges 10 and 12 that ceiling boards will be supported. The runner members 2 are arranged in a grid pattern so as to support ceiling boards on the flanges 10 and 12 within the grid pattern.

Each of the side walls has a groove 14 therein at the mid region thereof. The grooves extend outwardly from the side walls to form two parallel ledges 16 and 18 on the inside of the U-shaped body configuration. The grooves 14 extend below and outwardly of these parallel ledges 16 and 18. The grooves, in effect, form an overhang over a portion 20 of the side walls.

The side walls have a cutout 22 therein which is used to receive the end of a runner member 2. The cutout actually exists in the lower portion 20 of the side wall and the flange 12. The upper portion of the side wall 6, which overlies the groove 18 and actually forms the groove 18, is not cut out. A section of the lower portion 20 of the side wall is removed and the width of the area cutout is equal to the distance between two side walls 4 and 6 measured from opposite portions 20 of each of the side walls. The flange 12 also has a cutout with the flange cut back at a 45° angle, as shown by element 26 of the drawing. On one side of the cutout flange 12 there is provided a tab 28 which extends slightly beyond the end of the flange.

Figure 2:
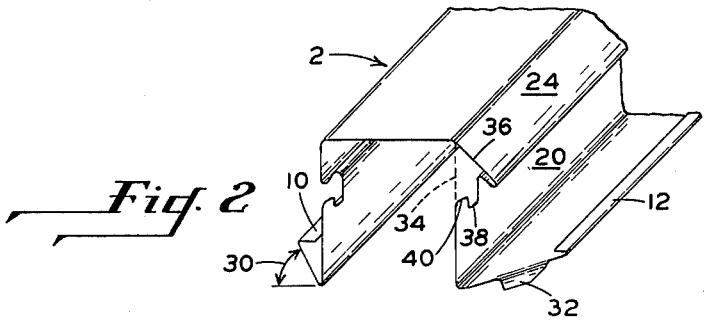
FIG. 2 is a perspective view of an end configuration of a runner structure which is meant to be fastened to the side of the runner structure of FIG. 1.
Figure 3:
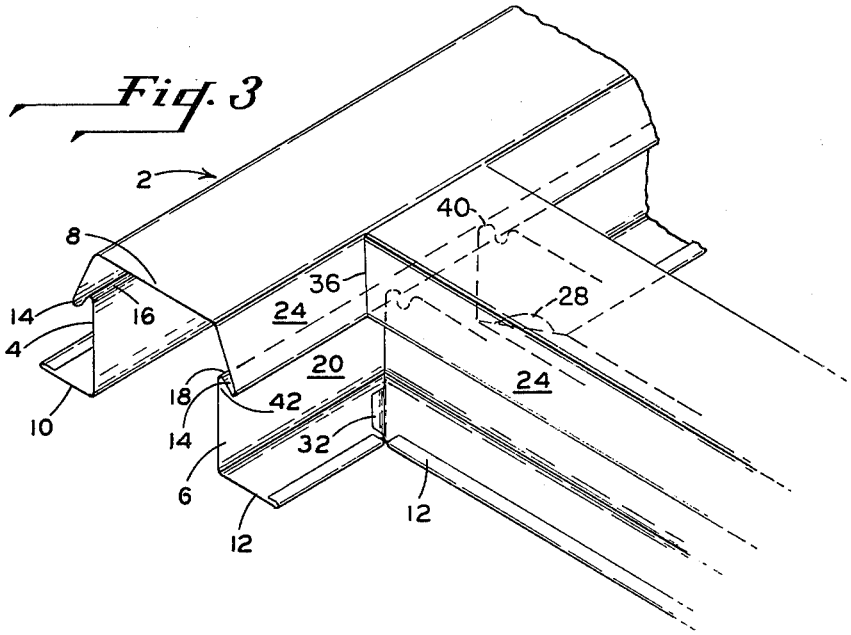
FIG. 3 is a view of two runner structures being fastened together with the end of one runner structure engaging the side of another runner structure.

FIG. 1 is a showing of a runner member 2 with the side cut out, but the end configuration in no way altered to engage the cutout 22. FIG. 2 is a view of the end of a runner 2 which has been altered to engage the cutout 22. The runners 10 and 12 have been cut back at an angle of 45°, as shown by element 30. One of the flanges is provided with a tab 32. The lower portion 20 of the side walls 4 and 6 are not cut. However, the upper portion 24 of the side walls 4 and 6 are cut back at an angle from the original edge 34 of the runner 2. The dotted line indicated as element 34 shows the original edge of the runner. An angle of approximately 22° is cut into the upper portion 24 of the side walls so that the edges 36 of the runner 2 will now engage the inclined surface of portion 24 above the cutout 22. In effect, the end of the runner has been configured so that it conforms to the contour of one side wall. In cutting out a portion of the upper portion 24 of side walls 4 and 6, a notch 38 is provided in the lower portion 20 of the side walls. This notch provides a protrusion or hook element 40 which slides under the overhanging groove of the side wall. The protrusion slides up into engagement in recess 42 (FIG. 1) and helps lock the end of the runner member to the side wall of an adjacent runner member. One tab 32 overlies one flange member, and tab 28 goes under another flange member so as to further assist in holding the runner members 2 in position. The positioning of the two tabs 28 and 32 prevent relative movement of the flanges 10 and 12 of one runner member adjacent the cutout flange 12 of another member, and thus permits the protrusion 40 to maintain its engagement with the recess 42. This locks together the two runner members to help establish the grid system of a suspended ceiling system.

The runner members are normally painted black and are made from sheet metal. They are bent into the required configuration and suspended from the structural ceiling of a room. Either conventional wire suspension means or special suspension structures may be used to suspend the runner member 2 at a spaced distance from the structural ceiling of a room. A number of runner members are engaged together with the ends of some of the runner members engaging sides of other runner members to form a grid pattern arrangement of the runner members. Into this grid pattern arrangement, conventional fibrous ceiling boards are positioned. All parts of a conventional ceiling system are well known and conventional in the art, with the inventive concept herein being the cross-sectional configuration of the runner member and the connection means utilized to connect together two adjacent runner members.

What is claimed is:

1. A ceiling suspension system comprising at least two runners, each runner having an elongated sheet metal body with a generally inverted U-shaped configuration, said runner having two side walls connected together at their one ends with a flat top member, the opposite ends of the sides having horizontal flanges which extend outwardly from the body of the runner to support ceiling boards on either side of the runner, said side walls having grooves therein, said grooves extending outwardly from the side walls to form two parallel ledges inside the U-shaped body configuration, said grooves extending below and outwardly of the parallel ledges to form the outside of the side wall with an overhang having a recess therebelow, the end of one runner abutting the side of a second runner, said runner having its side and adjacent flange partly cut away, said end of the other runner having a portion of the end cut away to form two hook elements on said side walls, and said hook elements engage the recess below the overhang on the outside of the side walls just above the cutaway portion in the side wall and flange.

2. The ceiling suspension system of claim 1 wherein adjacent the cutout said flange of said second runner means has a tab that rests on a flange of the first runner means and the other flange of the first runner has a tab which rests on the flange of the second runner.

* * * * *